United States Patent [19]

Owen et al.

[11] Patent Number: 4,559,699

[45] Date of Patent: Dec. 24, 1985

[54] METHOD OF CONSTRUCTING A PADMOUNTED DISTRIBUTION TRANSFORMER

[75] Inventors: Timothy C. Owen; Charles J. Witzigman, both of Jefferson City, Mo.

[73] Assignee: Westinghouse Electric Corp., Pittsburgh, Pa.

[21] Appl. No.: 618,844

[22] Filed: Jun. 8, 1984

[51] Int. Cl.[4] ..... H01F 41/00

[52] U.S. Cl. ..... 29/602 R; 29/460; 174/50

[58] Field of Search ..... 174/50, 52 R; 29/460, 29/602 R

[56] References Cited

U.S. PATENT DOCUMENTS 3,784,727 1/1974 Haubein ..... 174/59 X 3,841,032 10/1974 Grannis ..... 174/50 X

*Primary Examiner*—Howard N. Goldberg

*Assistant Examiner*—Timothy V. Eley

*Attorney, Agent, or Firm*—D. R. Lackey

[57] ABSTRACT

A method of constructing a top-loaded padmounted distribution transformer in which closing of the transformer tank by welding on a top cover is one of the final manufacturing operations. Weld damage to the painted surfaces, which occurs when the cover is welded to the tank, is confined to areas outside of the terminal cover which may be repaired by production line painting techniques, utilizing the terminal cover to "mask" components on the terminal wall.

5 Claims, 8 Drawing Figures

FIG. 4
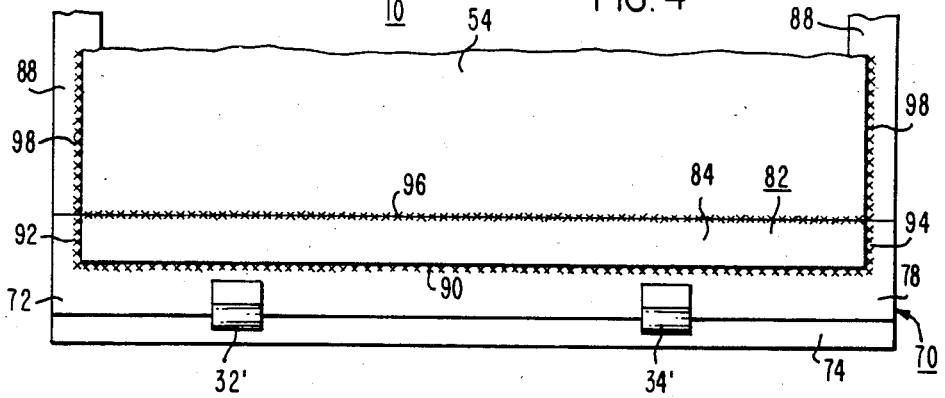
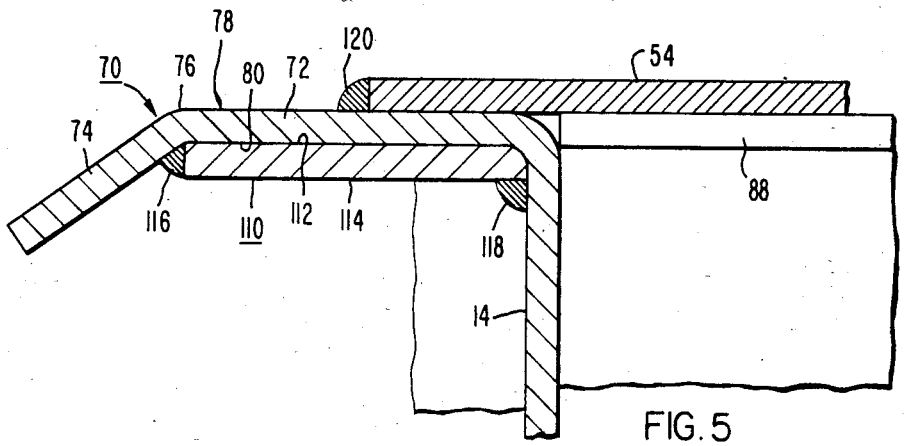
FIG. 5
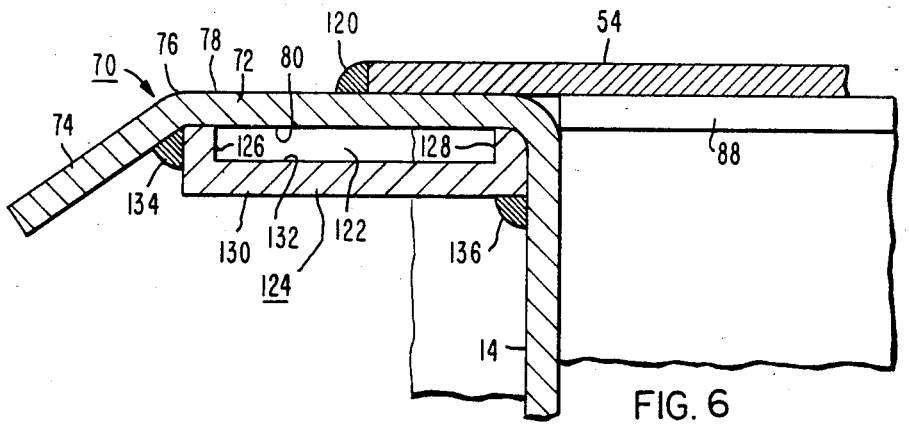
FIG. 6

METHOD OF CONSTRUCTING A PADMOUNTED DISTRIBUTION TRANSFORMER

BACKGROUND OF THE INVENTION

1. Field of the Invention

The invention relates in general to electrical transformers, and more specifically to new and improved methods of constructing padmounted distribution type transformers.

2. Description of the Prior Art

In the manufacture of padmounted distribution type transformers, top-loading the core-coil assembly has many advantages over side loading. For example, the transformer may be tested in the orientation in which it will be used, there is no need to add and remove excess oil for testing, it is easier and less costly to repair units which fail a test during manufacture, and it eliminates welding after painting in an area near the electrical ground on the terminal wall.

Welding of the front panel, on side-loaded distribution transformers, requires the time consuming masking of the terminals and other components mounted on the front panel, the cleaning of the weld area, and finally the priming and painting of the heat damaged areas. These labor intensive tasks are not eliminated by merely going to top loading, because the operation of welding the cover to the top of the tank still causes heat damage to surfaces enclosed by the terminal cover.

SUMMARY OF THE INVENTION

Briefly, the present invention is a new and improved method of constructing a top-loaded padmounted distribution transformer which eliminates heat damage to the surfaces inside the terminal cover due to welding the tank cover, confining heat damaged areas to external surfaces which may be cleaned, primed and painted by production line techniques. The front panel of the tank which mounts the electrical terminals or bushings, and other components, includes an integral flange at its upper end which recesses the terminal wall. A metallic bar is secured to this flange prior to the initial priming and painting of the tank. The initial priming and painting produces a thick tenacious coating of paint, such as achievable by the powder coating techniques using powdered resin.

After the core-coil assembly is tanked and liquid dielectric is introduced into the tank, such as transformer oil, the tank cover is welded on. An edge of the tank cover is butt welded to the metallic bar, if the bar is on the upper surface of the integral flange. An edge of the tank cover is lap welded to the integral flange if the metallic bar is mounted on the lower surface of the integral flange. These arrangements confine heat damage due to tank cover welding to areas located outside of the terminal compartment, eliminating cleaning damaged paint from underneath the integral flange, as well as eliminating the time consuming tasks of masking, priming and painting the terminal wall. It also preserves the excellent paint coating on the terminal wall, enhancing corrosion resistance of this critical area.

The weld heat damage is thus confined to external surfaces of the terminal cover-tank assembly, permitting production line techniques, e.g., robots, to be used to clean, prime and paint the damaged areas. The painting of the damaged areas need not be a special painting step, but may be performed during the final external painting of the composite enclosure formed by the tank and cabinet. The terminal cover is closed before the cleaning, priming and painting operations, to automatically mask the components located on the terminal wall.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 4 is a fragmentary, plan view of the padmounted transformer shown in FIG. 2, illustrating the location of certain of the welds shown in cross section in FIG. 3;

FIG. 5 is a view similar to that of FIG. 3, except the metallic bar shown on the upper surface of the front panel extension in FIG. 3 is mounted flush with the lower surface of the front panel extension;

FIG. 6 is a modification of the embodiment set forth in FIG. 5, illustrating that the metallic bar may be configured such that the bar and lower surface of the front panel extension cooperatively form an air pocket;

DESCRIPTION OF THE PREFERRED EMBODIMENTS

Figure 1:
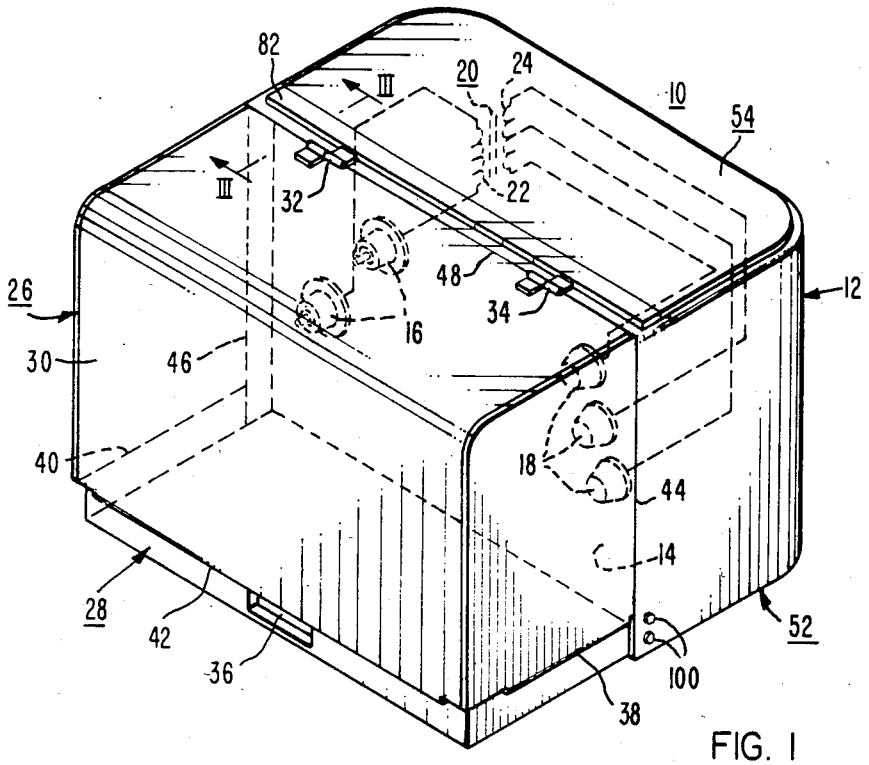
FIG. 1 is a perspective view of a padmounted transformer constructed according to a first embodiment of the invention.

Referring now to the drawings, and to FIG. 1 in particular, there is shown a padmounted electrical distribution transformer 10 constructed according to a first embodiment of the invention. Transformer 10 includes an enclosed metallic tank portion 12 having a front panel or terminal wall 14 on which electrical terminals are mounted, such as high voltage bushings 16 and low voltage bushings 18. A core-coil assembly 20 is disposed within tank 12, immersed in a suitable liquid dielectric, such as mineral oil. The core-coil assembly 20 includes a primary winding 22 which is connected to the high voltage bushings 16 and a secondary winding 24 which is connected to the low voltage bushings 18.

A cabinet or compartment 26 is formed adjacent to the front panel 14 of tank 12, for enclosing the bushings 16 and 18, the cables which rise from the ground and connect to the bushings, as well as the other items commonly disposed on the front panel of tank 12. Cabinet 26 includes a U-shaped sill 28 which is attached to the tank 12, and a terminal cover or hood 30 which is pivotally attached to the tank 12 via hinges 32 and 34. Terminal cover 30 has an open position (not shown) which enables authorized personnel to gain access to the terminal compartment, and the closed position illustrated. In the closed position, cover 30 is locked to the sill 28 via a padlock (not shown) in a sill recess 36, and the cover 30 cooperates with the sill 28 to provide tamper-resistant side interfaces 38 and 40, and a front interface 42. Cover 30 also cooperates with the tank 12 to provide tamper-resistant side interfaces 44 and 46, and a top interface 48.

Figure 2:
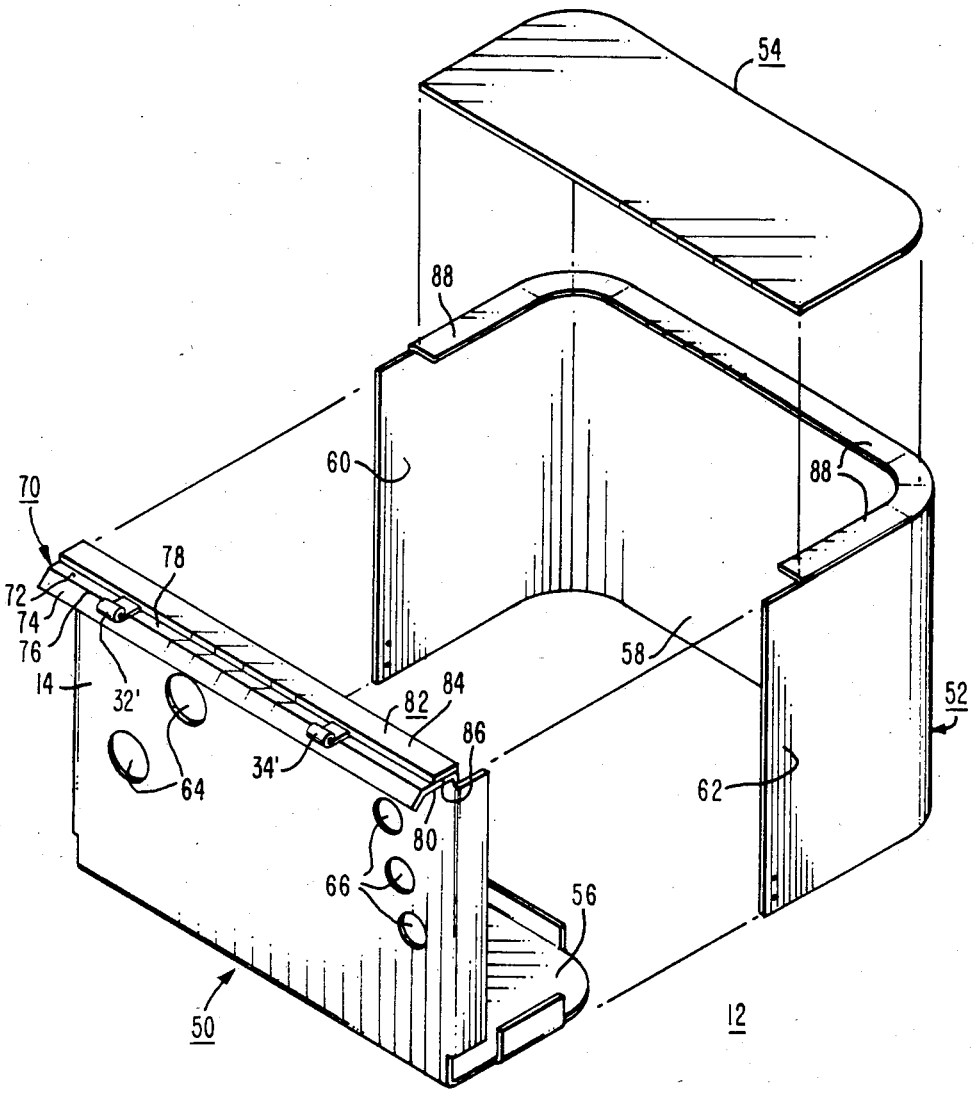
FIG. 2 is an exploded, perspective view of the various elements which are assembled to construct the tank portion of the padmounted distribution transformer shown in FIG. 1, including a front panel extension and metallic bar welded to its upper surface.

As shown most clearly in FIG. 2, which is an exploded perspective view of tank 12, tank 12 may be constructed from first, second and third basic structural members 50, 52 and 54, respectively. This construction of tank 12 is claimed in concurrently filed Application Ser. No. 618,845. The first member 50, which starts as a flat sheet of steel, includes front 14 and a bottom portion 56 of tank 12. The second member 52, which also starts as a flat sheet of steel, is a substantially U-shaped side wrap, forming a back wall 58 and first and second side walls 60 and 62 of transformer tank 12. The first and second members 50 and 52 are welded together to form an enclosure having an opening at its top, to which the third member 54, the tank cover, is subsequently welded as one of the final manufacturing steps. Front 14 has openings 64 for receiving the high voltage bushings 16 and openings 66 for receiving the low voltage bushings 18.

Front panel 14 includes a flange or front panel extension 70 across its upper edge which cooperates with the side wrap 52 in recessing the front panel 14. Flange 70 includes a substantially horizontally oriented portion 72. As taught in concurrently filed Application Ser. No. 618,843, flange 70 may also include a portion 74 which angles downwardly from portion 72, from a bend line 76, to cooperatively form a new and improved tamper-resistant interface with the terminal cover 26. The horizontally oriented portion 72 includes upper and lower flat surfaces 78 and 80, respectively, with the portions 32' and 34' of hinges 32 and 34, respectively, being welded to the upper flat surface 78.

According to a first embodiment of the invention, an elongated metallic bar 82 is firmly secured to one of the surfaces 78 or 80 of the flange portion 72. In the various embodiments of the invention, the method of attaching the metallic bar to the flange 72 will be described as welding with a continuous bead. It is to be understood, however, that the important criterion is to firmly secure the bar to the flange, with moisture seals at the seams. Thus, tack welds, or even an adhesive, may be used to secure the metallic bar, with the seams between the bar and the adjacent metal being suitably caulked.

In the first embodiment, bar 82 has a substantially rectangular cross sectional configuration, including upper and lower major flat surfaces 84 and 86, respectively, with the lower flat surface 86 being disposed in surface-to-surface contact with the upper flat surface 78. At this point, bar 82 has three of its edges lap welded to surface 78 of flange 70.

Figure 3:
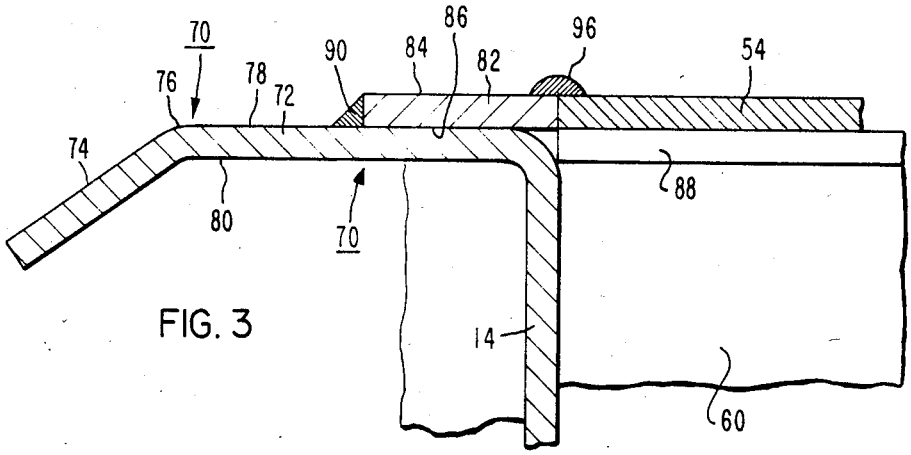
FIG. 3 is a fragmentary view, in section, taken between and in the direction of arrows III—III in FIG. 2, illustrating the first embodiment of the invention set forth in FIGS. 1 and 2.

FIG. 3 is a cross sectional view of tank 12, taken between and in the direction of arrows III—III in FIG. 1, and FIG. 4 is fragmentary plan view of FIG. 1, with both of these figures illustrating the welding of bar 82 to surface 78. The longitudinal edge of bar 82 which faces the bend line 76 is welded to surface 78 with a lap weld 90, and the ends of bar 84 are welded to surface 78 with lap welds 92 and 94.

In constructing a padmounted transformer according to the new and improved methods of the invention, structural members 50 and 52, including metallic bar 82, are formed and welded together to form an enclosure having an open upper end. The upper edge of member 52 is flanged, as illustrated at 88, to form a flat surface for subsequently receiving the tank cover 54. After members 50 and 52 are welded together and the welds are cleaned, the subassembly is primed, heated and passed through a cloud of powdered resinous insulation to form a tough, tenacious protective coating over the external and internal surfaces of the subassembly. The components associated with the front panel 14 are then mounted thereon, including the high and low voltage bushings 16 and 18, respectively. The core-coil assembly 20 is then loaded into tank 12 through the open upper end, and secured within the tank. Windings 22 and 24 are connected to bushings 16 and 18, respectively, and the enclosure is filled with a liquid insulating and cooling dielectric, such as mineral oil. The unit is tested, and the cover 54 is welded to the assembly to seal the tank 12. Cover 54 has one edge butted tightly against the unwelded edge of bar 82, and these two mating edges are butt welded together with a butt weld 96. The remaining edges of cover 54 are lap welded to the tank flange 88, such as indicated by lap welds 98.

The U-shaped sill 28 is bolted to the side wrap member 52, as indicated by bolts 100, and the terminal cover is pivotally attached to the tank by inserting the hinge pins to complete hinges 32 and 34.

The terminal cover 26 is closed to shield the front panel 14 and its components from paint, and the cover welds 96 and 98 are cleaned, primed and painted. The disclosed construction prevents heat damage to the previously painted surfaces located within the enclosure formed by the terminal cover 26, and the closed terminal cover automatically shields the internal components during the repairing of the external cover welds. The cleaning, priming and painting of the cover welds are simple operations which may be handled by production line techniques, including robots, if desired. The painting of the welds may be accomplished simultaneously with the final overcoat of paint applied to the external surfaces of the padmounted transformer enclosure.

The disclosed method enables top loading of the core-coil assembly 20 and the welding of cover 54 without incurring damage to the superior paint coatings within the enclosure formed by the terminal cover. This assures excellent corrosion resistance in the front panel area where it is most critical, as the repairing of the original powder coated surfaces is never as good from the corrosion protection standpoint as the original prime and paint coating which can be applied by heating the metal and melting particles of paint resin in a controlled cloud of particles. Further, the disclosed method eliminates the hand labor previously required to clean the damaged surfaces inside the enclosure, to mask the components on the front panel, and to prime and paint the damaged areas. The only heat damaged surfaces which have to be repaired after cover welding are external surfaces which can be easily repaired, and also easily inspected and touched up as needed during actual use, without deenergizing the padmounted transformer.

Figure 8:
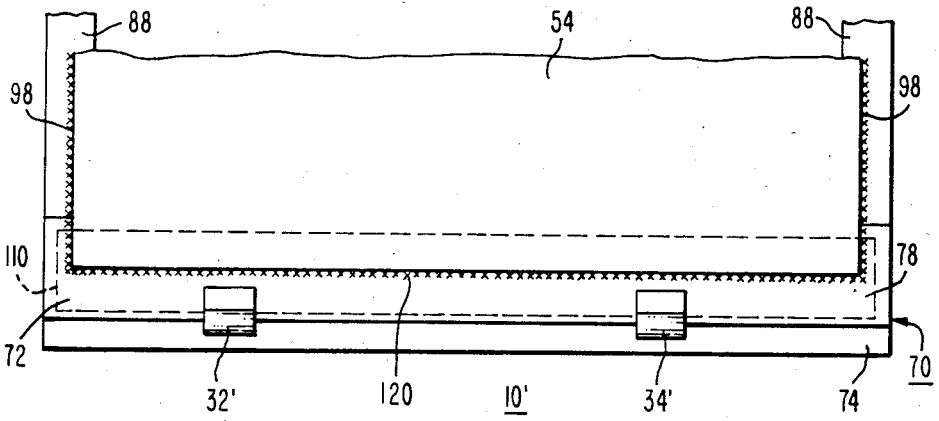
FIG. 8 is a plan view of a padmounted distribution transformer, similar to the view shown in FIG. 4, except illustrating the embodiments of FIGS. 5, 6 and 7.

It has been found that heat damage to the painted surfaces on the front panel 14 and other internal surfaces may be prevented by securing a metallic bar to the lower surface 80 of flange 70 prior to the initial painting operation, instead of to the upper surface 78, and by extending a dimension of cover 54 such that an edge of cover 54 extends substantially to the midpoint of surface 78 of the horizontal portion 72 of flange 70. FIG. 5 is a view similar to that of FIG. 3, except illustrating a flat metallic bar 110 welded to the lower surface 80 of flange 70. Bar 110 has upper and lower major flat surfaces 112 and 114, respectively, with upper surface 112 being disposed in surface-to-surface contact with lower surface 80 while its edges are lap welded to surface 80 and front 14 with lap welds 116 and 118, respectively. Cover 54 is dimensioned to extend to substantially the midpoint of surface 78 which is backed by bar 110, and instead of being butt welded to bar 84, it is lap welded to surface 78 with weld 120. Surfaces 80 and 112 below weld 120 become hot enough to destroy paint, but these surfaces are not painted. Surface 114, which is painted, is not damaged by the lap weld. FIG. 8 is a fragmentary plan view of a transformer 10' which illustrates the embodiment of FIG. 5.

Figure 7:
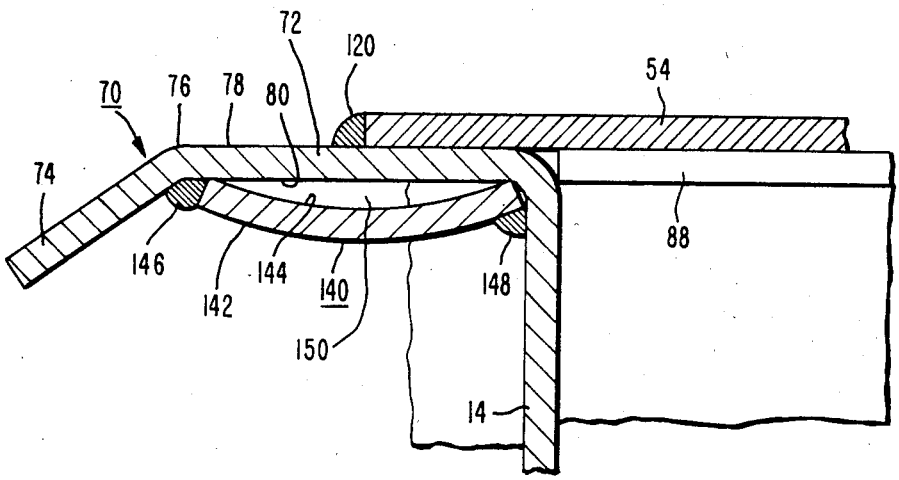
FIG. 7 is a modification of the embodiment shown in FIG. 6 illustrating a configuration for the metallic bar which may also be used to create an air pocket with the lower surface of the front panel.

FIGS. 6 and 7 are similar to FIG. 5, except illustrating that bar 110 may be configured to create an air pocket 122 between surface 80 and the metallic bar. In FIG. 6, a metallic bar 124 is illustrated having a substantially U-shaped cross sectional configuration, which includes leg portions 126 and 128 extending perpendicularly outward from a straight bight portion 130, to form right angles. The ends of legs 126 and 128 are disposed against surface 80, forming an air pocket 122 between surface 80 and surface 132 on the inside of the U-shaped configuration. Welds 134 and 136 secure leg portions 126 and 128, respectively, to surface 80 and to the front panel 14. FIG. 7 is similar to FIG. 6, except illustrating a bar 140 having a curved cross sectional configuration. Bar 140 has convex and concave surface 142 and 144, respectively, with bar 140 being positioned such that its concave surface 144 faces surface 80, with the longitudinal edges of bar 140 being placed in contact with surface 80 of flange 70. Welds 146 and 148 secure bar 140 to surface 80 and to the front panel 14, while creating an air pocket 150 between surfaces 80 and 144. The plan views of the embodiment shown in FIGS. 6 and 7 would be essentially the same as the plan view of the FIG. 5 embodiment shown in FIG. 8.

We claim as our invention:

1. A method of constructing a padmounted distribution transformer including a top-loaded tank having terminals on a recessed terminal wall, a terminal cover pivotally attached to the tank, and a sill which supports the cover in its closed position, comprising the steps of:

forming the terminal wall of the tank with an integral flange having upper and lower surfaces, said flange forming a front panel extension which recesses the terminal wall, securing a metallic bar to one of the surfaces of said integral flange, assembling tank components, including the terminal wall, to provide a tank having an opening at its upper end, painting said tank, attaching components to the terminal wall, including electrical terminals, placing a core-coil assembly and liquid dielectric in said tank, welding a tank cover on said tank, to seal the opening at its upper end, attaching the terminal cover to said tank, closing said terminal cover to protect the terminal wall, and painting at least the area which includes the tank cover weld.

2. The method of claim 1 wherein the step of securing a metallic bar to the integral flange secures it to the upper surface of the flange, and the step of welding the tank cover to said tank includes butt welding an edge of the cover to an edge of the metallic bar.

3. The method of claim 1 wherein the step of securing a metallic bar to the integral flange secures it to its lower surface, with the step of welding the tank cover including the step of lap welding an edge of the tank cover to the integral flange.

4. The method of claim 3 wherein the step of securing a metallic bar to the lower surface of the integral flange includes placing a flat major surface of the metallic bar against the lower surface.

5. The method of claim 3 wherein the step of securing a metallic bar to the lower surface of the integral flange includes the step of creating an air pocket between the lower surface of the integral flange and the metallic bar.

* * * * *